United States Patent [19]

Black

[11] Patent Number: 4,720,314

[45] Date of Patent: Jan. 19, 1988

[54] PROCESS FOR PRODUCING SELF-CRIMPING POLYESTER YARN

[75] Inventor: William B. Black, Pensacola, Fla.

[73] Assignee: Celanese Corporation, New York, N.Y.

[21] Appl. No.: 941,888

[22] Filed: Dec. 15, 1986

Related U.S. Application Data

[60] Division of Ser. No. 780,464, Sep. 26, 1985, Pat. No. 4,661,404, which is a continuation-in-part of Ser. No. 583,801, Mar. 2, 1984, abandoned, which is a continuation of Ser. No. 373,755, Apr. 30, 1982, abandoned, which is a continuation-in-part of Ser. No. 267,482, May 26, 1981, abandoned, which is a continuation-in-part of Ser. No. 157,130, Jun. 6, 1980, abandoned.

[51] Int. Cl.[4] ..... D01D 5/20

[52] U.S. Cl. ..... 156/167; 156/244.24; 156/244.25; 264/167; 264/168; 264/103; 264/177.13; 264/177.17; 264/177.19; 264/211.12; 264/211.14; 264/342 RE

[58] Field of Search ..... 264/103, 167, 168, 342 RE, 264/177.13, 177.17, 177.19, 211.12, 211.14; 156/167, 244.24, 244.25

[56] References Cited

U.S. PATENT DOCUMENTS

| | | | |
|---|---|---|---|
| 3,219,739 | 11/1965 | Breen et al. | 264/177 F |
| 3,914,488 | 10/1975 | Gorrafa | 428/397 |
| 4,332,757 | 6/1982 | Blackmor et al. | 264/177 F |
| 4,332,758 | 6/1982 | Blackmor et al. | 264/177 F |
| 4,351,147 | 9/1982 | Blackmor et al. | 264/177 F |

FOREIGN PATENT DOCUMENTS

| | | | |
|---|---|---|---|
| 9883 | 4/1980 | European Pat. Off. | 264/177 F |
| 7725 | 6/1980 | European Pat. Off. | 264/177 F |
| 41820 | 12/1981 | European Pat. Off. . | |
| 1934845 | 1/1970 | Fed. Rep. of Germany . | |
| 2835706 | 2/1979 | Fed. Rep. of Germany . | |
| 42-22339 | 9/1968 | Japan | 264/177 F |
| 44-16804 | 7/1969 | Japan | 264/177 F |
| 50-2650 | 1/1975 | Japan | 264/103 |
| 50-6583 | 3/1975 | Japan | 264/171 |

*Primary Examiner*—Jan H. Silbaugh
*Assistant Examiner*—Hubert C. Lorin
*Attorney, Agent, or Firm*—Forrest D. Stine

[57] ABSTRACT

Polyester polymer is extruded at different speeds through groups of parallel closely spaced orifices at relatively high spinning speeds. The resulting filament have high and low shrinkage regions substantially regularly spaced apart along their length. A yarn including a number of these filaments spontaneously develops crimp when relaxed.

23 Claims, 8 Drawing Figures

PROCESS FOR PRODUCING SELF-CRIMPING POLYESTER YARN

This application is a division of application Ser. No. 780,464, filed Sept. 26, 1985, now U.S. Pat. No. 4,661,404, which is a continuation-in-part of application Ser. No. 583,801, filed Mar. 2, 1984, now abandoned, which is a continuation of application Ser. No. 373,755, filed Apr. 30, 1982, now abandoned, which is a continuation-in-part of application Ser. No. 267,482, filed May 26, 1981, now abandoned, which in turn is a continuation-in-part of application Ser. No. 157,130, filed June 6, 1980, now abandoned.

The invention relates to the production of polyester filaments having high and low shrinkage regions along their length and to yarns including a number of these filaments. Such yarns spontaneously develop crimp when heated while relaxed.

BACKGROUND OF THE INVENTION

Japanese Pat. No. 43-22339 discloses extruding at low spinning speeds various polymers through combined orifices. Each combined orifice includes a large diameter central capillary and two or more smaller diameter satellite capillaries. The lengths of the various capillaries are not specified. The spun yarns are drawn under unspecified conditions yielding yarns composed of drawn filaments having cross-sectional shapes which vary continuously and cyclically along the length of each filament. When attempts were made to duplicate the teachings of this reference with polyester polymer, yarn drawn at normal draw ratios and the heated while relaxed exhibited only a small amount of crimp. When the draw ratio was reduced experimentally to an unusual ratio, the crimp level in the relaxed yarn increased to a marginally useful level. But fabrics made from either of these yarns have a harsh hand.

Japanese Patent Publication No. 42,415/1979 (which corresponds to U.S. patent application Ser. No. 825,495, filed Aug. 17, 1977) discloses spinning two polyester streams through a spinneret with converging capillaries. One of the streams has a higher speed than the other. The streams intersect in mid-air below the spinneret and upon attenuation, form a combined stream. An oscillation occurs in the combined molten stream such that the combined stream, when quenched into a filament, exhibits thick and thin regions along its length. When a number of these filaments are combined into a yarn and relaxed, a highly useful degree of crimp is obtained. Crimp development was said to be based on formation of alternating S-twist and Z-twisted helically coiled sections, i.e., in the manner of classical false twist texture. Fabrics made from the yarn typically have a soft, luxuriant hand. But, reproducibly manufacturing the spinnerets with converging capillaries is quite difficult leading to non-uniformity of yarns. There is a continuing need for self crimping yarns similar in nature to those described in Japanese Patent Publication No. 42,415/1979, which can be made in a more reproducible manner.

Applicant undertook research to explore basic aspects of the fibers and yarns described in Japanese Patent Publication No. 42,415/1979. It was found that filament structure and the mechanism of crimp development were different than previously believed. Briefly, it was found that the thick and thin sections in the filaments shrink, upon thermal treatment, in varying amounts. The thick sections shrink more than the thin sections. Yarns composed of these filament crimp upon thermal treatment because the greater shrinkage portions of filaments causes buckling of neighboring low shrinkage portions of filaments. The instant invention stems from this discovery.

In the invention, difficulties of the prior art processes are reduced or avoided and latently crimpable yarns having improved properties are provided.

SUMMARY OF THE INVENTION

A simple and readily reproducible process for forming a latently crimpable, as spun, polyester yarn using parallel spinneret capillaries has now been discovered. The invention is conducted by melt spinning a bundle of filaments which includes a plurality of polyester filaments having shrinkage peaks and valleys out of phase from filament to filament. One or more of the filaments having shrinkage peaks and valleys is formed by extruding from at least one group of at least two substantially parallel spinneret capillaries, at least first and second molten streams of polyester polymer of fiber-forming molecular weight. The first stream has a greater velocity than the second stream and is spaced laterally from the second stream a small distance such that the first and second streams periodically unite to form a combined stream having thick and thin regions. The combined stream is coalesced and attenuated into the one filament prior to solidification and quenching. The filament is withdrawn at a spinning speed above about 1500 meters per minute (about 1650 yards per minute). The spinning speed and velocities and lateral spacing upon extrusion, of the first and second streams are selected so that the shrinkage peaks and valleys along the filament are substantially regular and periodically spaced.

In advantageous embodiments of the various process aspects of the invention, the polyester filaments having shrinkage peaks and valleys are generated by extruding from groups of three substantially parallel spinneret capillaries first, second and third coplanar molten streams of polyester polymer of fiber forming molecular weight. The first stream is situated between and spaced laterally from each of the second and third streams a small distance selected so the three streams periodically unite below the spinneret into a combined stream having thick and thin regions. The combined stream is coalesced and attenuated into one filament. The first stream is advantageously larger than the second and third streams which, in turn, are of substantially the same size.

Product aspects of the invention are directed to the yarns produced by the process of the invention and to as spun latently crimpable yarns. Advantageously, as spun, latently crimpable yarns of the invention include a plurality of the polyester filaments made with the three hole group of spinnerets described above. These polyester filaments are characterized by a quadralobal cross section defined by substantially perpendicular major and minor axes. Major lobes, i.e., lobes with large cross sections, are located at the ends of the minor axis and minor lobes, i.e., lobes with smaller cross sections, are located at the ends of the major axis. The polyester filaments are further characterized by substantially regular variations in thickness along length and periodic shrinkage peaks and valleys in substantially regular alternating sequence. Yarns including these filaments are latently crimpable, as spun, when the shrinkage peaks and valleys and variations in thickness are out of phase from filament to filament. The yarns have a crimp-to-shrinkage ratio of greater than 0.25, more advantageously greater than or equal to 0.4. When thermally treated, while relaxed, the yarns spontaneously develop crimp. When spun at speeds above about 4100 meters per minute (about 4500 yards per minute), the low shrikage portion of the filaments are highly oriented and the yarn has a shrinkage of less than about 20%. These yarns are a highly desirable commercial product without a drawing treatment. When spun at speeds below about 4500 yards per minute, the yarns can be treated in a further draw-texturing step to provide a spun like yarn with broken filaments protruding from the yarn.

Other aspects of the invention will in part appear hereinafter and will in part be obvious from the following detailed description taken together with the accompanying drawings.

BRIEF DESCRIPTION OF THE DRAWINGS

In the drawings which form part of the original disclosure of the invention.

DEFINITIONS AND TEST METHODS

Figure 1:
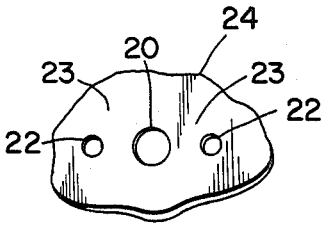
FIG. 1 is a plan view of a portion of the lower or extrusion face of an exemplary type of spinneret usable in the process of the invention.

"Polyester" is used herein to mean those polymers of fiber-forming molecular weight composed of at least 85% by weight of an ester or esters of one or more dihydric alcohols and terephthalic acid.

"Fully drawn denier" is used herein to mean the denier the filament would have if drawn at 50 meters per minute in contact with a 50 cm. hot shoe heated to a temperature of 90° C., with the draw ratio selected to give an elongation-to-break of 35%.

Shrinkage profile of filaments (and 5 cm. shrinkages) are determined by separating from the yarn bundle a single filament 2.5 meters long. Care must be taken not to stretch the filament. The filament is then cut into consecutive serially numbered 5 cm. segments. These are placed while unrestrained in boiling water for 30 seconds. The length of each segment is then measured, and its shrinkage as a percentage of the original 5 cm. length is calculated. For example, if a segment has a length of 4.2 cm. after the treatment with boiling water, its shrinkage would be 16%. The percentage shrinkages, when plotted in serial number order, provides a profile of shrinkage variation along the filament.

Yarn properties are determined differently. The yarn is conditioned for at least one hour in an atmosphere of 22° C. and 65% relative humidity. If the yarn is wound on a package, at least 100 meters are stripped off and discarded. The yarn is wound under a tension of 0.035 grams per denier on a Suter denier reel or equivalent device having a circumference of 1.125 meters to a total skein denier of approximately (but not to exceed) 8000, and the ends are tied. For example, for a 170 denier yarn, 24 revolutions would give a skein denier of 8160. In this instance, 23 revolutions would be used. The skein is removed from the denier reel and suspended from a 1.27 cm. diameter round bar. A 1000 gram weight is gently hung on the bottom of the skein with a bent #1 paper clip or equivalent piece of wire weighing less than 1 gram. After 30 seconds, the skein length is measured to the nearest 0.1 cm.. The measured length is recorded as L°. The 1000 gm. weight is then replaced with a 20 gm. weight, and the rod with the suspended skein and 20 gm. weight are placed in an oven at 120° C. for 5 minutes and then removed. The suspended skein is then conditioned for 1 minute at 22° C. and 65% relative humidity. The skein length $L_1$ is measured to the nearest 0.1 cm. The 20 gm. weight is then carefully replaced by the 1000 gm. weight. Thirty seconds after the 1000 gm. weight has been applied, the skein length $L_2$ is measured to the nearest 0.1 cm. The percentage crimp is then calculated as $$\frac{L_2 - L_1}{L_2} \times 100,$$

while the percentage yarn shrinkage is calculated as $$\frac{L_o - L_2}{L_o} \times 100.$$

The percentage bulk takes into account both the thickening of individual filaments due to shrinkage and the crimping of the filaments, and is calculated as follows:

$$\frac{L_o - L_1}{L_o} \times 100$$

Filaments in a skein can be so entangled that replacing the 20 gm. weight by the 1000 gm. weight will not cause a change in skein length even though the skein obviously has not had its crimp pulled out. In such a case, the 1000 gm. may be gently jarred until the weight falls and removes the crimp.

To characterize a yarn, 100 samples are tested by the procedures in this paragraph. The highest 10 and lowest 10 values are discarded. The other values are averaged to provide crimp and shrinkage values for the yarn.

DETAILED DESCRIPTION OF THE INVENTION

Figure 2:
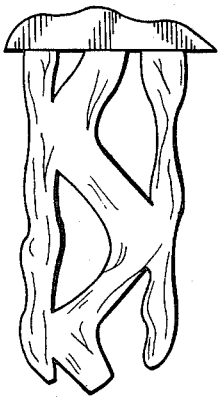
FIG. 2 is a schematic side view of the molten streams just below the face of the FIG. 1 spinneret.

As shown in FIGS. 1 and 2, polyester polymer is melt spun through a group of substantially parallel capillaries 20 and 22 in spinneret 24 to provide at least two molten sub-streams, one of which has a higher velocity than the other. The capillaries are spaced laterally a small finite distance selected such that the sub-streams unite below the spinneret into a combined stream having thick and thin regions.

Lateral spacing between the sub-streams is best kept in the range of from about 0.0635 mm. to about 0.127 mm., preferably less than about 0.102 mm. Lateral spacing in the range of about 0.0825 mm. to about 0.0838 has been found especially advantageous.

The size of satellite capillaries 22 and main capillary 20 can be varied depending on factors such as dpf of filaments, extrusion pressure, polymer I.V., spinning speed in the column, drawdown and similar factors. In general, preferred diameters for satellite capillaries range from about 0.175 mm. to about 0.230 mm. Best results have been obtained when satellite capillaries have a diameter of about 0.200 mm. and main capillary has a diameter in the range of about 0.275 mm. to about 0.305 mm. But, satellite capillary diameters or main capillary diameters can be increased or decreased. Any such change in one capillary is preferably accompanied by a proportional change in the other capillaries.

Advantageously, the lengths of the capillaries of the combined orifice will be equal. Though the capillary lengths can be as small as desired, limited only by spinneret structural considerations, it has been unexpectedly found that increasing the length of the capillaries provides improved bulk uniformity in yarns of the invention. Advantageously, the capillaries have a length greater than 0.46 mm., more advantageously greater than 0.70 mm., most advantageously greater than 0.96 mm. When each group of capillaries of the combined orifice share a combined counterbore at the polymer entrance end of the combined orifice, lengths of capillaries set forth above will not include the depth of the counterbore.

In one embodiment of the spinneret, illustrated in FIG. 1, capillary 20 has a diameter of 0.305 mm., while satellite capillaries 22 have diameters of 0.203 mm. The centers of capillaries 22 are 0.356 mm. from the center of capillary 20. Thus, the lateral spacing between capillaries is about 0.10 mm. All capillaries are 0.305 mm. in length. Preferred arrangements include coplanar capillaries, as illustrated in FIG. 1, wherein satellite capillaries have a diameter of 0.206 mm., main capillary has a diameter of 0.284 mm. with a spacing of 0.0825 mm. between each stream. In another preferred arrangement, the satellite capillaries have a diameter of 0.203 mm., main capillary has a diameter of 0.277 mm. and the lateral spacing between streams is 0.0825 mm. In each of the latter spinnerets, capillary lengths are about 1.02 mm.

Capillary 20 and its associated satellite capillaries 22 cooperate as a combined orifice for spinning a single filament, schematically shown in FIG. 2. Ordinarily, a plurality of combined orifices of groups of capillaries will be provided in a single spinneret so that the resulting multifilament yarn comprises more than one of the filaments according to the invention. Advantageously, all orifices of a spinneret will be combined orifices so that the multifimalent yarn will be composed solely of filaments according to the invention.

It is essential that one of the sub-streams have a higher velocity than at least one other of the sub-streams which unite to form a combined stream. Advantageously, the faster sub-stream will have a velocity of from 2 to 7 times the velocity of the slower stream(s). FIG. 2 illustrates qualitatively the periodic uniting of the molten sub-streams immediately below the spinneret specifically described above. Since all the capillaries in this instance are the same length, the larger sub-stream issuing from capillary 30 has a higher velocity upon extrusion than the sub-streams issuing from capillaries 22. The center sub-stream accordingly periodically strikes and bonds to one of the outer sub-streams, then buckles and periodically strikes and bonds to the other of the outer sub-streams. The combined stream thus formed is coalesced and attentuated and the various sub-streams unite side-by-side prior to solidifying to form a stream having periodic and regular thick and thin regions along its length. This stream is quenched as it is accelerated to the spinning speed, i.e., the speed at which the filament travels immediately after solidification. The resulting filament has properties uniquely determined by spinning speed.

Figure 3:
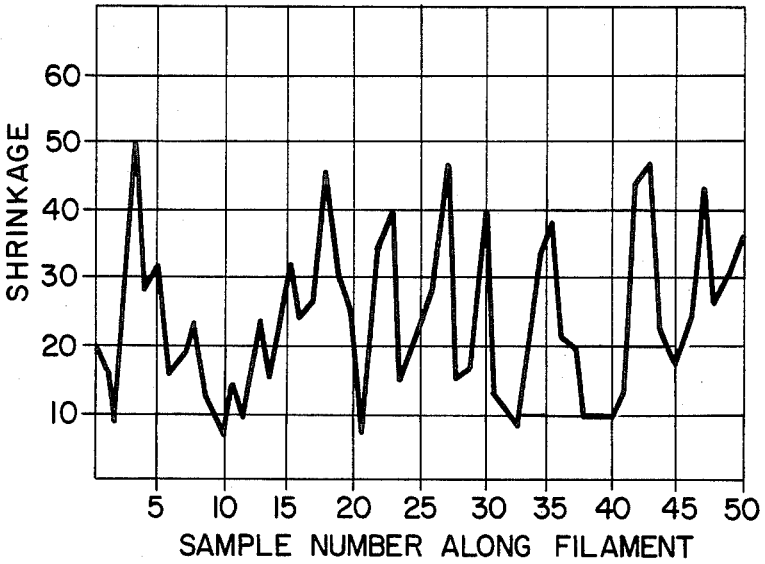
FIG. 3 PRIOR ART
FIGS. 3–6 are graphs of shrinkage profiles of various filaments, as will be set forth below.
Figure 4:
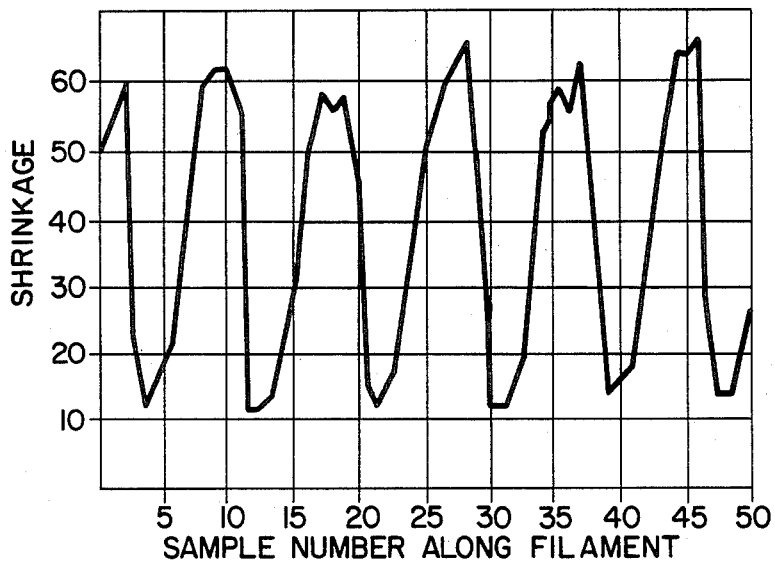
Figure 5:
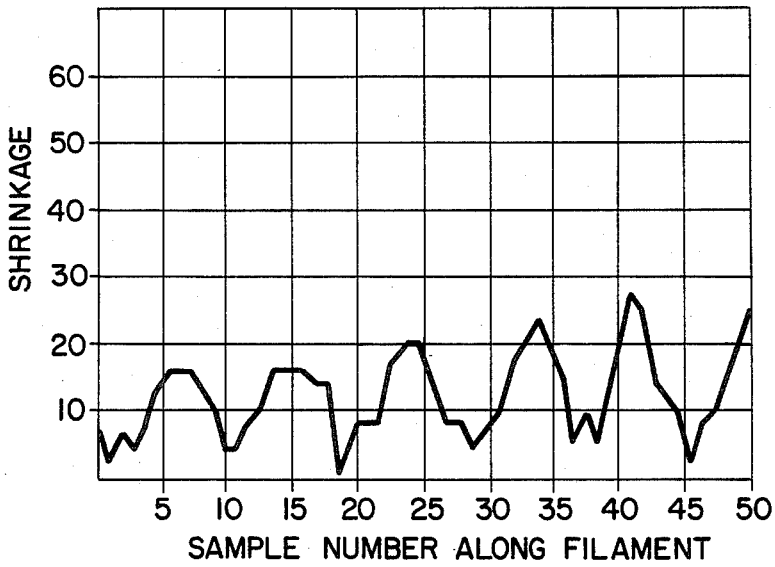
Figure 6:
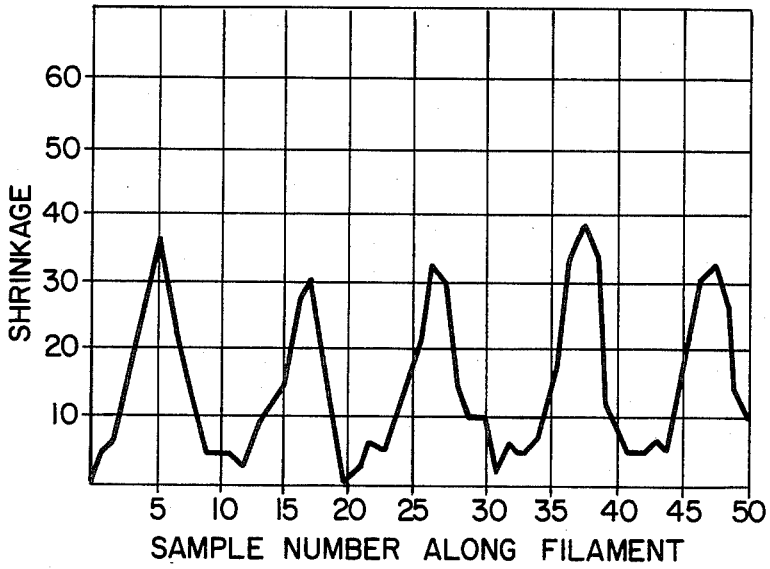

When using any of the spinnerets referred to above, random occurrence of shrinkage peaks of random amplitude and valleys along the length of the filaments is inherent when spinning at low speeds. As the spinning speed is increased above some level, a degree of regularity not unlike harmonic motion is achieved which is advantageous for various end uses. The spinning speed at which the almost wholly random character of the shrinkage profile changes to discernible regularity depends on spinneret design, polymer throughput rate, spun denier-per-filament, quenching conditions, and other similar parameters, and can readily be determined by simply increasing the spinning speed until the shrinkage profile displays substantial regularity. When the above spinnerets, ordinarily regularity becomes apparent in the vicinity of 1500–2500 meters per minute. Regularity of shrinkage peaks and valleys is illustrated by the contrast between FIG. 3 and FIGS. 4, 5 and 6. As discussed in greater detail in the Examples, FIG. 3 is an actual shrinkage profile of a polyester filament spun through a spinneret as illustrated in FIG. 1, but at low spinning speed and then drawn. FIGS. 4, 5 and 6 are shrinkage profiles of as spun polyester filaments provided according to the invention. It can be readily seen that shrinkage peaks and valleys are random in FIG. 3 and are both regular and periodically spaced in each of FIGS. 4, 5 and 6. It is believed that this substantial regularity and periodicity of shrinkage peaks and valleys forms a substantial part of the basis for improved crimp values and crimp to shrinkage ratios of the yarns of the invention.

Spinning is advantageously conducted in the invention to provide filaments having a fully drawn denier of less than 6. It is similarly preferred that the invention be conducted to provide yarns having a crimp of greater than about 2.5%, more preferably greater than 5%.

Crimp can be controlled in various ways. For example, it has been found that with a given spinneret, decreasing the denier per filament by decreasing polymer flow typically increases crimp. Alternatively, where all satellite capillaries have the same diameter and are smaller than the main capillary, decreasing the diameters of all capillaries while holding constant the ratio of small to large capillary diameters will, at least in some instances, increase crimp. Still another alternative for increasing crimp is to decrease the ratio of the satellite capillary diameter to the main capillary diameter.

Use of the latter is a preferred method of varying crimp. Thus, with spinnerets as illustrated in FIGS. 1 and 2, the satellite capillaries 22 can be held constant at a diameter in the range of between about 0.203 and 0.206 mm. which is preferred because of spinnability considerations. Then, increasing the diameter of main capillary 20 through the range of about 0.270 mm. to about 0.305 mm. will continuously increase crimp.

The invention is advantageously conducted to provide as spun yarns having a crimp to shrinkage ratio of greater than about 0.25, preferably greater than about 0.40. Shrinkage of yarns produced by the invention is dependent in part on crimp levels, i.e., increasing crimp typically increases shrinkage. Additionally, shrinkage decreases with increasing spinning speeds.

Figure 7:
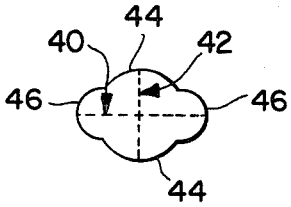
FIGS. 7 and 8 illustrate cross sectional and plan views, respectively, of polyester filaments prepared using a three hole spinneret as illustrated in FIGS. 1 and 2.
Figure 8:
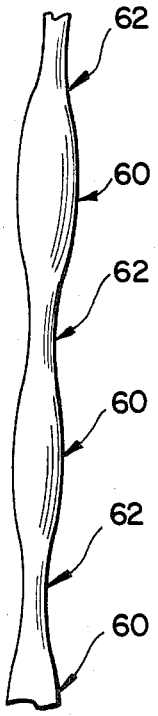

FIGS. 7 and 8 illustrate cross sectional and plan views of a segment of polyester filament prepared according to the invention using the three hole spinneret illustrated in FIGS. 1 and 2. The generally oval cross section of the filament is defined by substantially perpendicular major and minor axes 40 and 42 respectively.

Major lobes 44 are situated at the ends of the minor axis. Minor lobes 46 are situated at the end of the major axis. In some of the filaments spun in accordance with the process of the invention, the perpendicular major and minor axes define cross-sectional areas of substantial symmetry. The filaments have regularly spaced alternating thick regions 60 and thin regions 62.

The regularly spaced thick and thin regions of the filament are believed to cause the shrinkage peaks and valleys in the filament. Thus, thick regions 60 are substantially amorphous even though this filament is spun at high speeds. When the filament is exposed to thermal treatment while relaxed, the amorphous thick regions shrink more than do the thin regions.

The differental shrinkage is believed to cause crimping or bulk development in the yarn when the shrinkage peaks and valleys are out of phase from filament to filament. Upon thermal treatment of the yarn, high shrinkage portions of filaments adjacent low shrinkage portions of other filaments cause such low shrinkage portions of adjacent filaments to buckle causing bulking of the yarn, including, at times, the projection of individual filament loops above the yarn bundle surface.

As spun, latently crimpable yarns which are acceptable for direct use in fabrics without a drawing treatment are those having "fully oriented" character and are best produced by spinning at high speeds, i.e., between about 4100 to about 5200 meters per minute. When spun at speeds below 4100 meters per minute, the yarns exhibit shrinkage and elongation-to-break values greater than desirable for commercial yarns unless drawn. Shrinkage values for "fully oriented" yarns of the invention will be less than 20%, advantageously less than 15%. Spinning speeds of about 4570 meters per minute have been found to provide high quality, as spun, latently crimpable yarns.

Bulking of as spun, latently crimpable, high speed spun yarns of the invention is best accomplished after the yarns have been woven or knit into fabrics. Simply exposing the fabrics to thermal treatment, as by dyeing in a hot bath while maintaining the fabric relaxed, causes bulking and crimp development. After such bulk and crimp development, the fabric is advantageously stretched from about 5% to about 10%, preferably about 7%, using, e.g., a Tenter. Fabrics made from yarns of the invention have been found to have exceptionally good cover, good dye uniformity and unusually soft hand.

When spun at speeds below about 4100 meters per minute, the yarns lack the "fully oriented" character of yarns spun at higher speeds and have a "partially oriented" character. These are best drawn in a conventional manner prior to the use in fabrics.

It has been found that adjusting drawing or draw-texturing treatments to cause some filament breakage in the yarns provides advantageous spun-like properties in the yarn. The broken filaments protrude from the yarns giving the yarns an attractive spun-like feel.

"Partially oriented" character yarns of the invention are characterized by filament shrinkage profiles of increased amplitude, i.e., increased variation from shrinkage peaks to valleys. Further, the shrinkage profiles are such that these filaments have an average, per 5 meters along their length, of at least two regions possessing shrinkage above 40% and an average for each 5 meters of at least two regions possessing shrinkage valleys between peaks where each valley has at least two consecutive 5 cm. shrinkages below 20%.

As spun, latently crimpable yarns of the invention whether of "fully or partially oriented" character, are advantageously composed solely of filaments provided according to the invention, i.e., having regularly spaced shrinkage peaks and vallyes. It is recognized however, that other conventional and non-conventional filaments can be mixed or spun with filaments of the invention. Additionally, it is preferred that the filaments have a dpf in the range of between about 1 and about 10, more preferably about 2.25 and about 2.45. Yarns can have total deniers ranging from 40 to 500 or more. For example, yarns having total denier of 165 with 68 filaments or a total denier of 125 with 51 filaments when spun from three hole spinnerets, as illustrated in FIGS. 1 and 2, and at speeds of about 5000 ypm, have been found to be especially advantageous.

EXAMPLE I

This is an example within the teachings of Example 3 of Japanese Patent No. 43-22339. A spinneret having 34 combined orifices is provided, each combined orifice being constituted by a central capillary having a diameter of 0.300 mm. and three satellite capillaries having diameters of 0.200 mm. The satellite capillaries are equally spaced apart around the central capillary, and all capillaries have a length of 0.305 mm. Polyester polymer of normal molecular weight for apparel yarns is spun through the spinneret at a melt temperature of 300° C., at a rate of 73.5 grams per minute. The combined streams are conventionally quenched by transversely directed air into filaments at a spinning speed of 400 meters per minute and wound on a package.

The spun yarn is then conventionally drawn over a hot shoe heated to 90° C. at a draw ratio of 4.0 to yield a drawn yarn having a denier of 416, 33% elongation-to-break, tenacity of 2.7 grams per denier, shrinkage of 13.4% and crimp of 1.2%. The denier per filament is about 12, and fabric made from the yarn has poor cover and a harsh hand. Generally speaking, crimp is a desirable property while shrinkage is undesirable. The crimp-to-shrinkage ratio is thus a measure of the general desirability of the yarn. This low level of crimp, and the low value of the crimp-to-shrinkage ratio, makes the yarn far less valuable than yarns made according to the present invention.

The shrinkage profile along a filament from the drawn-yarn has the random character generally depicted in FIG. 3. While successive sample numbers 42 and 43 in FIG. 3 have shrinkages above 40%, this is not common in yarns spun at the low speeds of this example.

EXAMPLE II

The spun yarn in Example I is similarly drawn at a draw ratio of 3.2 to produce a drawn yarn having a denier of 515, elongation of 42%, tenacity of 1.6 grams per denier, shrinkage of 16.1% and a crimp of 3.0%. The denier per filament is about 15, and fabric made from the yarn also has poor cover and a harsh hand, as in Example I. While the crimp level is marginally useful, the undesirably low crimp-to-shrinkage ratio makes the yarn undesirable for many end used. The shrinkage profile is again similar to FIG. 3.

EXAMPLE III

Example I is repeated except that the spinneret is replaced with an embodiment of the FIG. 1 spinneret, there being 34 groups of combined orifices wherein main capillary has a diameter of 0.305 mm., satellite capillaries have diameters of 0.203 mm. and lateral spacing between capillaries of about 0.10 mm. The spun yarn is hot-drawn at a drawn ratio of 2.80 to yield a drawn denier of 565, an elongation of 102%, tenacity of 1.85, shrinkage of 22%, and a crimp of 1.8%. FIG. 3 is an actual shrinkage profile of a filament produced according to this example. Fabric made from this yarn has very poor cover and a quite harsh hand.

EXAMPLE IV

Example III is repeated except that the draw ratio is varied. Results obtained are set forth below:

| Draw Ratio | Bulk | Shrinkage | Crimp | C/S |
|---|---|---|---|---|
| 2.50 | 9.4 | 9.2 | 0.2 | 0.02 |
| 2.80 | 21.5 | 20.3 | 1.6 | 0.08 |
| 3.2 | 13.8 | 12.0 | 2.0 | 0.17 |

Thus, crimp and crimp-to-shrinkage ratios of the post-drawn slow-speed yarns are very low even when spun with a spinneret which as shown below, when used in accordance with the invention, will give extremely high crimp and crimp-to-shrinkage ratios.

EXAMPLE V

This example illustrates the practice of the invention. Polyester polymer is melt spun at spinning speeds of 3800 to 5000 ypm (3474 to 4572 m/m) using the same 34-hole spinneret used for Examples III and IV above. The results tabulated below show the high levels of crimp and crimp-to-shrinkage ratio characteristic of the as-spun yarns of the invention.

| Spinning (Take-up) Speed ymp(mpm) | DPF | Bulk % | Shrinkage % | Crimp % | C/S |
|---|---|---|---|---|---|
| 3800 (3474) | 4.2 | 43 | 34 | 15 | .51 |
| 4600 (4206) | 3.4 | 41 | 26 | 19 | .73 |
| 4800 (4389) | 3.3 | 35 | 22 | 17 | .77 |
| 5000 (4572) | 3.1 | 27 | 17 | 12 | .71 |

EXAMPLE VI

This example further illustrates practice of the invention. Polyester polymer is melt spun at 300° C. from the spinneret of Examples III, IV and V at a spinning speed of 3800 ypm (about 3420 meters per minute), the polymer rate being selected such that the resulting yarn has an average denier per filament (dpf) of 4.1. The shrinkage profile for a filament from this yarn is illustrated in FIG. 4. In contrast to the random pattern characteristic of slow speed spinning, the FIG. 4 filament has a pattern of quite regularly recurring broad shrinkage peaks alternating with broad shrinkage valleys The yarn has a shrinkage of 32.9% and a crimp of 15.5% for a crimp-to-shrinkage ratio of 0.47. The yarn is particularly suited for being draw-textured using a friction aggregate, downstream of the primary heater, for applying false twist, the draw ratio and aggregate speed being selected such that the filaments are broken in or after the aggregate to yield a spun-like yarn with broken filaments protruding from the yarn. The regularity of recurrence of the high and low shrinkage regions permits better control of the number of broken filaments per meter of yarn by selection of the draw-texturing process conditions. The breadth of the shrinkage peaks and valleys also contributes in this regard. By breadth is meant that at least two consecutive 5 cm. shrinkages along an individual filament are above 40%, in the case of a shrinkage peak, or are below 20%, in the case of a shrinkage valley.

EXAMPLE VII

Example IV is again repeated except that the spinning speed is increased to 5000 yards per minute (about 4500 meters per minute), and the polymer throughput is adjusted to provide an average of 3.2 denier per filament in the resulting yarn. The yarn has a crimp of 4.4% and a shrinkage of 9.7%, to give a crimp-to-shrinkage ratio of 0.45. FIGS. 5 and 6 are shrinkage profiles of two filaments from the same yarn, and illustrate the substantial regularity of occurrence of the shrinkage peaks and valleys. These figures also illustrate that the shrinkage peaks and vallyes are out of phase from filament to filament, and indeed have somewhat different repetition rates. Since the yarn was spun at high speed, it is sufficiently highly oriented to be capable of direct use in fabrics, giving an unusually soft hand and excellent cover, as compared to a conventionally textured yarn of equal number of filaments and equal denier per filament.

EXAMPLE VIII

The spinneret used in Examples IV–VII are modified by adjusting the lateral spacing of orifices 20 and 22 such that each land 23 between capillaries 20 and 22 has a width of 0.084 mm., and the length of the capillaries is increased to above 0.46 mm., e.g., to 0.508 mm. Example VIII is repeated, except using the spinneret design of this example. The yarns produced from successive doffs from the same spinneret, and from different spinnerets of the design of this example, are more uniform in bulk than those of Example VII above.

EXAMPLE IX

Example VIII is repeated, except the capillary lengths are increased to greater than 0.70 mm., specifically to 0.762 mm. Yarns so produced are still further improved in uniformity as compared to those made according to Example VIII.

EXAMPLE X

Example IX is repeated, except that the capillary lengths are increased to greater than 0.96 mm., specifically to 1.016 mm. Yarns so produced are still further improved in bulk uniformity as compared to those made according to Example IX. (See table below) The capillary diameters for this spinneret were 0.292 mm. and 0.203 mm., respectively, for the center and the satellite holes: The land width between the capillaries was 0.0825 mm. The 52-hour run consisted of 26 consecutive bobbins for each of three of the above spinnerets run side-by-side simultaneously at a spinning speed of 4480 M/M (4900 YPM).

| | Bulk | | Crimp (26 Bobbins) | |
|---|---|---|---|---|
| Spinneret | $\bar{x}$, %; | $\sigma$, % | $\bar{x}$, %; | $\sigma$, % |
| A | 32.3 | 1.17 | 14.6 | 0.96 |
| B | 32.8 | 1.09 | 14.9 | 1.02 |
| C | 32.4 | 0.76 | 15.0 | 0.79 |

| Run As A Whole (78 Bobbins) | |
|---|---|
| Bulk | |
| $\bar{x}$, %; | $\sigma$, % |

-continued

| | |
|---|---|
| 32.5 | 1.04 |

In addition to the excellent bulk uniformity provided by spinnerets with 1.016 mm. capillary length, the excellent crimp level and crip-to-shrinkage ratio obtained at high spinning speeds is shown by the average crimp % of 14.8% and average C/S of 0.72 for the 26 doff/78 bobbin run.

EXAMPLE XI

This example shows that the yarns of this invention exhibit high C/S ratios even for relatively low levels of bulk. The run consisted of eleven consecutive bobbins for each of three spinnerets of the preferred 1.016 mm. capillary length design run side-by-side simultaneously at a spinning speed of 4500 m/m (4920 ypm). The capillary diameters were, respectively, 0.206 mm. and 0.287 mm. for the satellite and center holes. Again the outstanding uniformity of bulk both in regard to bobbin-to-bobbin values for the same spinneret and spinneret-to-spinneret values is clearly evident for the preferred 1.016 capillary length design.

| | Bulk | | Crimp | | |
|---|---|---|---|---|---|
| Spinneret | $\bar{x}$, %; | o, % | $\bar{x}$, %; | o, % | C/S |
| A | 17.1 | 1.1 | 5.2 | 0.7 | 0.41 |
| B | 19.4 | 0.6 | 6.7 | 0.4 | 0.49 |
| C | 18.3 | 0.8 | 6.3 | 0.4 | 0.50 |

| Run As A Whole (33 Bobbins) | |
|---|---|
| Bulk | |
| $\bar{x}$, %; | o, % |
| 18.3 | 1.26 |

EXAMPLE XII

This example illustrates the excellent bulk uniformity obtained with yet another example of the preferred 1.016 mm. capillary length spinnerets, this one being designed to illustrate intermediate levels of bulk and crimp. The capillary diameters were, respectively 0.203 mm. and 0.285 mm. for the satellite and center capillaries; the land width was 0.0825 mm. The spinning run consisted of a 72-hour 144-bobbin run of 36 bobbins of each of 4 spinnerets run side-by-side simultaneously for the three days. The spinning was 4480 m/m (4900 ypm).

| | Bulk | | Crimp | | |
|---|---|---|---|---|---|
| Spinneret | $\bar{x}$, %; | o, % | $\bar{x}$, %; | o, % | C/S |
| A | 25.5 | 1.7 | 10.3 | 1.1 | 0.60 |
| B | 27.4 | 1.5 | 11.8 | 0.93 | 0.67 |
| C | 26.1 | 1.8 | 11.1 | 1.4 | 0.66 |
| D | 26.0 | 1.4 | 12.0 | 1.1 | 0.71 |

The invention has been described in considerable detail with reference to certain preferred embodiments. But variations and modifications can be made without departing from the scope and spirit of the invention as described in the foregoing specification and defined in the appended claims.

What is claimed is:

1. A process for forming a yarn, comprising melt spinning a plurality of polyester filaments having shrinkage peaks and valleys out of phase from filament to filament, wherein one or more of said plurality of filaments is generated by the steps comprising:

a. extruding from at least one group of at least two substantially parallel spinneret capillaries at least first and second molten streams of polyester polymer of fiber-forming molecular weight, said first stream being extruded at a greater velocity than said second stream and being spaced laterally from said second stream a finite distance selected such that said first and second streams periodically unite below said spinneret to form a combined stream having thick and thin regions;

b. coalescing and attenuating each combined stream and then quenching and solidifying each said combined stream into an individual filament having shrinkage peaks and valleys;

c. withdrawing each said filament from said combined stream at a spinning speed of at least about 1500 meters per minute, said spinning speed and the velocities and lateral spacing upon extrusion of said first and second streams being selected such that said shrinkage peaks and valleys along said filament are substantially regular and periodically spaced; and, d. gathering together said filaments into a yarn bundle.

2. The process defined in claim 1, wherein said filament has an average fully drawn denier less than 6.

3. The process defined in claim 1, wherein said first stream is larger than said second stream.

4. The process defined in claim 1, wherein said first stream has a velocity between 2 and 7 times as fast as said second stream.

5. The process defined in claim 1, wherein said capillaries have the same length.

6. The process defined in claim 5, wherein said capillaries have a length of at least 0.46 mm.

7. The process defined in claim 6, wherein said capillaries have a length of at least 0.70 mm.

8. The process defined in claim 7, wherein said capillaries have a length of at least 0.96 mm.

9. The process of claim 4 wherein said spinning speed and the velocities and lateral spacing upon extrusion of said first and second streams ae selected such that said filament has, for each 5 meters of length, an average of at least two regions possessing shrinkage peaks having at least two consecutive 5 cm. shrinkages above 40%, and an average of at least two regions possessing shrinkage valleys, said valleys having at least two consecutive 5 cm. shrinkages below 20%.

10. The process of claim 4 wherein said spinning speed and the velocities and lateral spacing upon extrusion of said first and second sub-streams are selected such that said yarn has a crimp-to-shrinkage ratio above 0.25.

11. The process defined in claim 10, wherein said filament has an average fully drawn denier less than 6.

12. The process defined in claim 11, wherein said first stream is larger than said second stream.

13. The process of claim 10 wherein said spinning speed and the velocities and lateral spacing upon extrusion of said first and second streams are selected such that said yarn has a crimp of at least 2.5%.

14. The process defined in claim 13, wherein said one filament has an average fully drawn denier less than 6.

15. The process defined in claim 14, wherein said first stream is larger than said second stream.

16. The process defined in claim 15, wherein said yarn has a crimp of at least 5%.

17. The process for forming a yarn, comprising melt spinning a plurality of polyester filaments having shrinkage peaks and valleys out of phase from filament to filament, at least one of said plurality of filaments being generated by the steps comprising:

a. extruding from at least one group of three substantially parallel spinneret capillaries first, second and third coplanar molten streams of polyester polymer of fiber-forming molecular weight, said first stream being extruded at a greater velocity than said second and third streams and being situated between and spaced laterally from each of the second and third streams a finite distance selected such that said first, second and third streams periodically unite below said spinneret to form a combined stream having thick and thin regions;

b. coalescing and attenuating each combined stream and then quenching and solidifying each said stream into an individual filament having shortage peaks and valleys;

c. withdrawing each said filament from said combined stream at a spinning speed and the velocities and with a lateral spacing upon extrusion of said first, second and third streams being selected such that said shrinkage peaks and valleys along said one filament are substantially regular and periodically spaced and said filament has a crimp-to-shrinkage ratio above 0.25; and, d. gathering together a plurality of said filaments into a yarn bundle.

18. The process of claim 17, wherein said spinning speed and the velocities and lateral spacing upon extrusion of said first, second and third sub-streams are selected such that said filament has a crimp-to-shrinkage ratio of greater than or equal to about 0.4.

19. The process of claim 18, wherein all of said capillaries and coplanar molten streams are circular in cross-section and said capillaries have the same length.

20. The process of claim 19, wherein said first coplanar molten stream has a larger diameter than said second and third coplanar molten streams.

21. The process defined in claim 20, wherein said capillaries have a length of greater than about 0.46 mm.

22. The process defined in claim 21, wherein said capillaries have a length of greater than about 0.70 mm.

23. The process defined in claim 22, wherein said capillaries have a length of greater than about 0.96 mm.

* * * * *